United States Patent [19]

Tillotson

[11] 4,194,655

[45] Mar. 25, 1980

[54] SWIMMER'S WALLET

[76] Inventor: Richard Tillotson, Suite 1777, Pioneer Plz., 900 Fort St. Mall, Honolulu, Hi. 96813

[21] Appl. No.: 940,231

[22] Filed: Sep. 7, 1978

[51] Int. Cl.[2] ..... A45C 1/04

[52] U.S. Cl. ..... 224/191; 150/42

[58] Field of Search ..... 224/240, 251, 235, 236; 150/38, 42, 45, 28 R, 37, 34, 52 R, 43, 35; 190/41 R, 59

[56] References Cited

U.S. PATENT DOCUMENTS

| | | | |
|---|---|---|---|
| 593,640 | 11/1897 | Caldwell | 224/236 |
| 1,291,914 | 1/1919 | Kelley | 150/28 R |
| 2,039,887 | 5/1936 | Colletti | 150/42 |
| 2,303,248 | 11/1942 | Allen | 150/42 |
| 2,439,731 | 4/1948 | Hawes | 150/38 |
| 2,647,071 | 7/1953 | Schade | 150/38 |
| 2,732,875 | 1/1956 | Martin | 150/34 |
| 3,280,870 | 10/1966 | Bundy | 150/42 |
| 3,403,716 | 10/1968 | Sinis | 150/28R |

FOREIGN PATENT DOCUMENTS

| | | | |
|---|---|---|---|
| 512198 | 6/1952 | Belgium | 150/38 |
| 1032089 | 6/1953 | France | 150/38 |

*Primary Examiner*—Kenneth W. Noland
*Attorney, Agent, or Firm*—James C. Wray

[57] ABSTRACT

A waterproof wallet, which is a highly protective receptacle for driver's licenses, credit cards, and cash, is adapted to be attached to a garment of a surfer. A foldable member houses two hermetically sealable inner pockets. Two openings are formed and sealed in the member to provide means of attachment when the member is folded or left open.

30 Claims, 9 Drawing Figures

FIG. 1
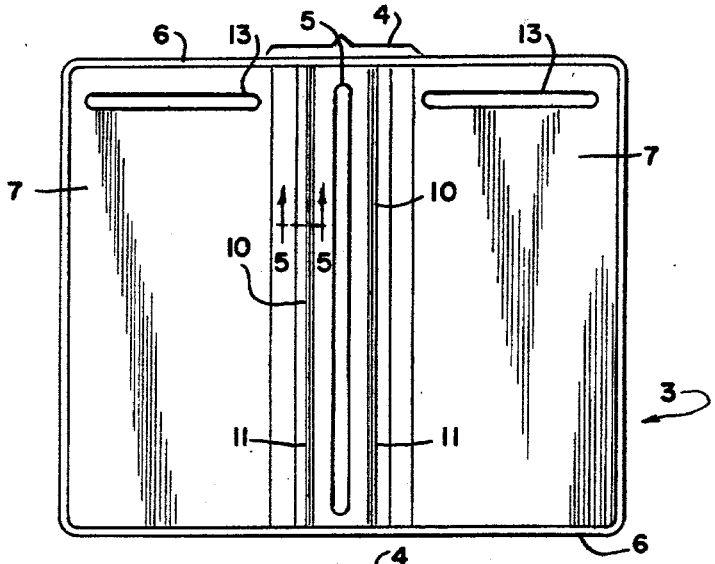
FIG. 2
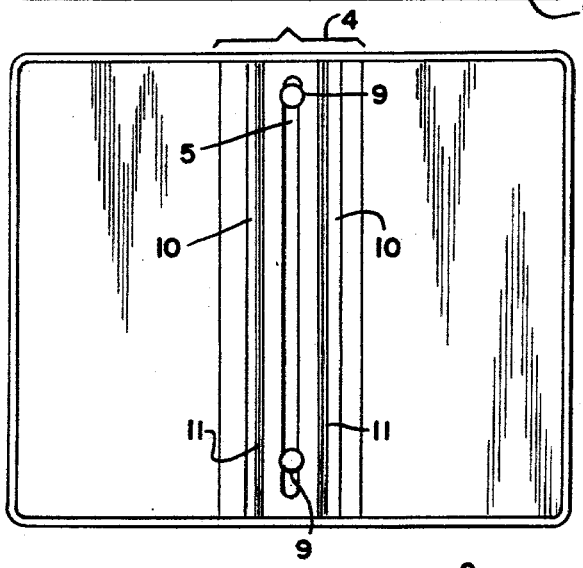
FIG. 3
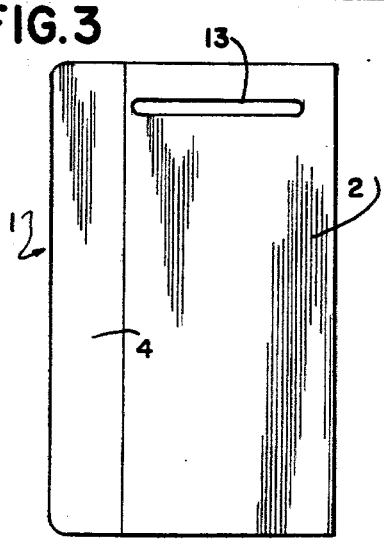
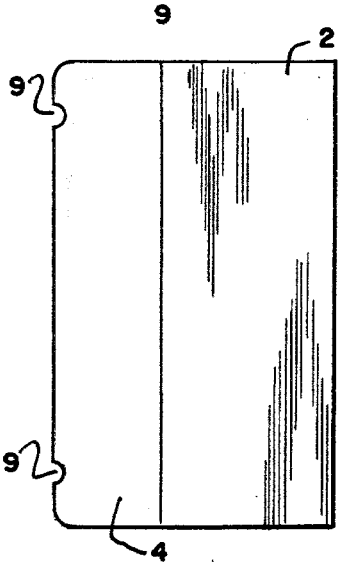
FIG. 4
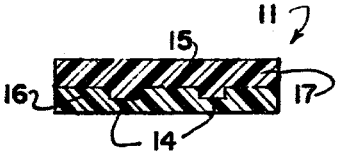
FIG. 5

SWIMMER'S WALLET

BACKGROUND OF THE INVENTION

The waterproof surfer's wallet of the present invention relates generally to the field of Package and Article Carriers and more particularly has reference to bathers' waterproof receptacles.

DESCRIPTION OF THE PRIOR ART

Pertinent art is found in Class 2, Apparel, subclasses 251 and 252; Class 24, Buckles, Buttons, Clasps, etc., subclasses 81MC, 85R, A and B; Class 150, Cloth, Leather and Rubber Receptacles, subclasses 26 through 47, and 52; and Class 224, Package and Article Carriers, subclasses 5R, 5L, 26R, C, E, G, H, and 28R.

Examples of relevant patents which we found are U.S. Pat. Nos.:

1,314,392, 1,525,333, 1,792,862, 1,920,061, 2,039,887, 2,392,533, 2,521,047, 2,647,071, 2,701,223, 3,361,312, 3,374,508.

U.S. Pat. No. 2,039,887 shows a waterproof purse made of rubber with an artificial leather covering. A Ziploc at its mouth renders it impervious to water. An optional non-rust metal fastener provides additional security. The purse is attached to the wearer by means of a belt.

U.S. Pat. No. 1,792,862 shows a pocketbook in the form of a foldable receptacle with three compartments, and comprising safety means of attachment to a wearer's belt. A retaining member attaches to the belt, and a chain with a cross bar attaches the member to the pocketbook. The pocketbook has six round openings: a pair of corresponding holes through each side of the top of the three compartments, just below their openings. These six holes are in registration when the pocketbook is folded, permitting insertion and securing of the cross bar.

U.S. Pat. No. 1,525,333 shows a bather's purse made of rubber and attachable to the wearer by a safety pin. The mouth of the purse is gripped between the arms of a clamp which also holds the safety pin. The safety pin provides no stability to the closure.

U.S. Pat. No. 2,647,071 shows a method of making a laminated case construction of the single fold type for wallets. The case is plastic with a set of stiffening members placed around the edges just inward of a marginal band. A limp pocket forming member of similar material is placed on the inner side having no sealing means at its mouth.

U.S. Pat. No. 2,392,533 shows a billfold with eyelet openings. These openings positioned at the ends of the billfold facilitate axial insertion of a strap which is then fastened around a wearer's limb.

U.S. Pat. No. 3,361, 312 shows a belt pocket comprising a canvas receptacle and a cover flap through which a wearer's belt will extend as an attachment means. For easier detachment a wire holder is implemented. The receptacle can then be removed without unbuckling the belt.

U.S. Pat. No. 2,701,223 shows a method of manufacturing a pair of plastic wallets. The inner walls of the wallets are of two pocket forming strips with transparent window areas.

U.S. Pat. No. 1,314,392 shows a metal water-tight bathing purse. On the inside are sealed packing glands and binder rings. A case suspension hook is attached to the case.

U.S. Pat. No. 1,920,162 shows a canvas bathing belt comprising a pocket which closes by means of a zipper.

U.S. Pat. No. 2,521,047 shows a waterproof pocket which is sewn to the swim apparel. It provides a waterproof closure consisting of a resilient clamp bar and clip.

Many problems remain in the prior art. Those which relate to waterproof purses such as are worn by bathers and shown in U.S. Pat. Nos. 2,039,887 and 1,525,333 are not suitable for use while surfing or participating in an active aquatic sport. While performing a sport, one's body must be free of extra weight and bulk. Holding means requiring belt attachments necessitate wearing a belt and are therefore not applicable to a surfer. Attachment by means of a strap around the limb could be dangerous to a surfer as could a fastening means comprising a pin or any similar object.

Furthermore, none of the prior art shows a connecting means easilty adapted to the strings of a swimsuit.

None of the prior art shows a waterproof purse thin enough to be slipped into a pocket of a swimsuit after its attachment. The billfolds which are shown are adapted for everyday land use and do not comprise sealing means. The pocketbook shown in U.S. Pat. No. 1,792,862 comprises registered loops for means of closure and attachment but these loops are formed on both sides of the holding means. There are no foldable wallets made of plastic with sealed means for attaching the two folded members.

The Ziplock shown in U.S. Pat. No. 2,039,887 does not alone provide a secure sealing means since there is nothing to keep it from buckling and opening.

SUMMARY OF THE INVENTION

The present invention provides a lightweight and economical waterproof wallet suitable for use by a surfer or any person engaging in aquatic sports. Very often a person spending long periods of time in the water needs a means for carrying his possessions such as driver's license and credit cards on his person. The present invention provides such a means, whereby these possessions may be securely protected within waterproof pockets. These pockets are inside of a lightweight plastic outer covering which has means that provide direct attachment to a swimsuit. There is no need for any supplemental means of closure or attachment which adds unnecessary bulk and weight.

The plastic outer covering is a foldable member which is slim enough to fit in a pocket of a swimsuit. The inner pockets are adapted to receive articles such as credit cards and driver's license which are normally made of a stiff plastic material. The contents thus serve as a strong reinforement for the pockets when they are sealed. The sealing means in the form of ziplocs provide hermetic, lightweight closures.

Two openings in the form of small holes can accomodate the strings of a swimsuit and the wearer can tie them in a number of ways depending on how he wants to position the wallet. The wallet can then be placed in a pocket or left on the exterior of the swimsuit.

The assets of this invention lie in its comfort and in its adaptability to aquatic use, when the wearer is engaged in active body movement for periods of time during which he must be free of extraneous articles and weight.

The simplicity of the design of the invention and of the materials used is another asset. The various parts of the wallet are made from waterproof plastic materials. The outer covering is made of an opaque plastic, flexible enough to fold, but reinforced by an area of a thicker plastic substance at the fold to provide strength and durability. The design of the wallet is similar to a billfold. The sealing means add bulk to the inner portion of the wallet. It is also made from a plastic material and is an integral part of the outer covering and the inner pockets. The wallet may be produced at a low cost in a simple manner and is applicable to various purposes.

In a preferred form, the wallet is made in an elongated rectangular shape. A short fold extends medially and transversely between the longitudinally extended edges. The fold and seals are parallel to a short side of the wallet. This shortens the length of the seal required. Since the danger point for leakage is the seals, the shorter seal produces a better, less leakage prone wallet. The wallet tends to flex about a transverse axis. By putting the seals parallel to a transverse axis, the seals are less likely to be bent and are less like to leak or break.

The relatively short medial fold makes it possible to hang the wallet across a belt or pocket edge with less danger of loss and less discomfort.

A preferred form of seals are seals known as Ziplocs and particularly an extruded form of Ziplocs known as Number 7 Flextype Mini-Grip in a preferred form of the invention deep, tight Ziplocs are especially extruded for watertight use.

Overall dimensions of a preferred form of the embodiment are about $8\frac{7}{8}''$ by $2\frac{3}{4}''$. When folded the dimensions are 4-7/16" by $2\frac{3}{4}''$. Three-sixteenth inch holes are formed in the fold and are set approximately $\frac{5}{8}''$ from each edge.

The two holes are provided to receive a tie strap or pin so that the wallet may be secured to swimsuits or jogging shorts. Other attachment means are suitable, and a person may hold the wallet by a string or a gold chain or by whatever means is appropriate or desirable. The holes further provide that there be no bulky unnecessary attachment means to encumber those people who simply put the wallet in their pocket.

In a preferred embodiment the wallet of the present invention is made of four pieces of material. An outer sheet is made of a plastic material preferably with a rough or suede-like non-skid surface so that the wallet does not slip out of the pocket. Two inner pocket sheets are sealed around three edges to the outer sheet, leaving inward facing openings. A middle inner sheet is centrally secured to the outer sheet and extends into the openings formed by the pocket sheets. The middle sheet may be secured to the outer sheet along the lines of fold and hole reinforcements and along outer longitudinally extended edges of the outer sheet. Complementary sealing portions are found on adjacent surfaces of the middle inner sheet and near open ends of the pocket sheet. Free edges of the pocket sheets adjacent the seals may be reinforced or colored and are used as poles to separate the seals. The pocket sheets are creased slightly outward and parallel to the seals to indicate marginal areas near the seals in which the pockets should not be loaded and to provide a break line for apportional stresses on outer portions of the wallet. After one inserts cards or money or keys or other materials in the pocket, one simply compresses the complementary seal portions toward each other, completing the seal. When the wallet is folded, the seals lie adjacent each other. The seals and the central fold and the pocket creases tend to reinforce the stability of the central portion of the wallet against bending of the seals, maintaining the water-resistant qualities of the wallet pockets.

Pocket sheets and the middle inner sheet may be formed of similar clear plastic materials. A desirable material for the outer sheet is a material such as Velvin plastic.

OBJECTS OF THE INVENTION

One object of the present invention is the provision of a waterproof wallet having holding means for card-type important articles.

Another object of the invention is to provide sealing means for the holding means. The sealing means comprises locks whose effectiveness is reinforced by the presence of the contents in the holding means.

Still another object of the invention is the provision of an area of reinforcement, for extra strength and sturdiness, located at the fold of the wallet.

Another object of the invention is the provision of an attachment means for securing the wallet to a user's swimsuit. In one form of attachment the foldable member remains open.

A further of the invention embodied in a second means of attachment is the provision for a means of closure. Attachment of the wallet in its folded form facilitates closure of the wallet as well, so as to prevent unnecessary movement or flapping.

Another object of the invention is the provision of a water resistant wallet to be attached to a surfer's garment having a foldable member, a pocket, a closure on the pocket and attaching means to secure the wallet.

A further object of the invention is the provision of a stiffened wallet mounted on the foldable member on opposite sides of a fold and comprising the fold, for providing strength.

Another object of the invention is the provision of a waterproof wallet having two transparent plastic pockets formed on opposite sides, a fold, and sealable mouths opening toward and parallel to the fold.

Another object of the invention is the provision of a waterproof wallet having two strips in a middle plastic member housing plural grooves to accomodate plural ribs correspondingly formed at mouths of two pockets.

A further object of the invention is the provision of a waterproof wallet having two openings located on the fold of the plastic foldable member and spaced equidistant from the edges for attaching the wallet to clothing.

Another object of the invention is the provision of a waterproof wallet having a folded member which is longitudinally extended and having a relatively short transverse medial fold and elongated generally rectangular pockets closed along longitudinally extended sides thereof and one longitudinal end and opened at a longitudinal end near the transverse fold and having means at the open end for securing the pocket in a complete watertight seal and an integrally formed opening tab formed as a free edge of each pocket extending between longitudinally extended sides at the open end thereof.

Another object of the invention is the provision of a waterproof wallet having a crease in each pocket extending transversely between longitudinally extending sides and slightly spaced from and parallel to a seal at an open end.

Another object of the invention is the provision of a waterproof wallet formed of an outer generally rectangular elongated sheet, first and second inner pocket sheets joined along three exterior edges of the pocket sheets to corresponding edges of the outer sheet and having open ends slightly spaced from the central fold, an inner central sheet positioned medially on the outer sheet and extending transversely between opposite longitudinally extended edges and being peripherally sealed to the outer sheet, a relatively short transverse fold and reinforced holes being formed in the outer sheet and middle inner sheet, and parallel first and second sealing means on the middle inner sheet for connecting to complementary sealing means on inner end portions of the pocket forming sheets.

These and other objects of the invention are apparent in the disclosure which includes the above and below specifications and claims and drawings.

BRIEF DESCRIPTION OF THE DRAWINGS

FIG. 1 is a view of the inside of the wallet with attaching means of a first embodiment.

FIG. 2 is a view of the inside of the wallet with attaching means of a second embodiment.

FIG. 3 is a view of the wallet of FIG. 1 in a folded position.

FIG. 4 is a view of the wallet of FIG. 2 in a folded position.

FIG. 5 is a cross-sectional view of the sealing means.

DETAILED DESCRIPTION OF THE DRAWINGS

Figure 7:
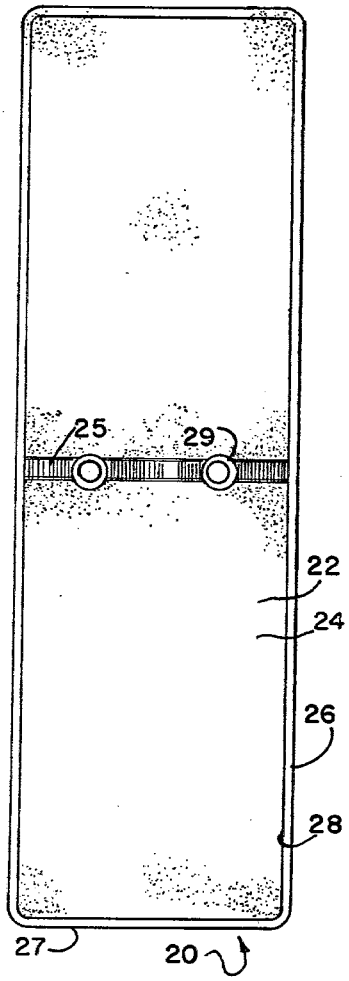
FIG. 7 shows the preferred embodiment in open position.
Figure 6:
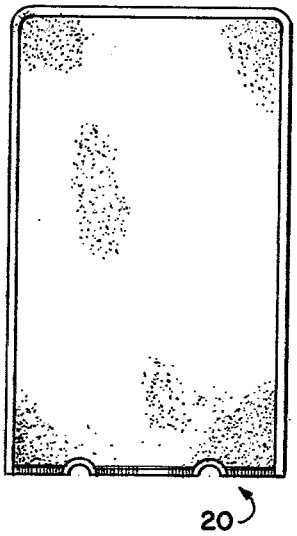
FIG. 6 is a view of the preferred form of the wallet.

In FIG. 3 the wallet 1 is shown in a folded position ready for attachment to a swimsuit and optional placement in a pocket. The outer embodiment 2 of one half of the foldable member 3 is made of a Velvin plastic.

In a first embodiment, an inner view of the foldable member 3 is shown in FIG. 1. A reinforced area of double flextite 4 comprises the fold 5 and extends in either direction away from the fold to the openings 13. As further reinforcement, a plastic seam forms the outer edge 6 of the foldable member 3.

The two pockets 7 are made of a transparent plastic material. They extend the entire height of the foldable member 3 and include openings 13 which are sealed in the pockets 7 and the foldable member 3. The mouths 10 of the pockets 7 are sealable by means of Ziplocks 11.

The two openings 13 in the form of loops are mounted into the foldable member 3 and the pockets 7. When the member 3 is folded along fold 5, the two openings 13 are in registration and form opening 14 as shown in FIG. 3. In this embodiment, the string of a swimsuit may be inserted through opening 14 for easy attachment to a user.

In a second embodiment as shown in FIG. 2, the reinforced area 4 contains the means of attachment in the form of circular openings 9 located on the fold 5 at points equidistant from the outer edge 6. FIG. 4 shows a closed view of this embodiment. The string of a swimsuit is brought through both holes and then the two ends are brought together and tied. The wallet 1 rests in a folded open position.

In FIG. 5, the Ziploc 11 is shown in a cross-sectional view taken from FIG. 1 at line 5—5. Two plastic strips 16 and 17 have a groove 14 and a rib 15 respectively which are fitted together to form a waterproof sealing means.

In the preferred form of the invention as shown in FIGS. 6–9, a waterproof wallet is generally referred to by the numeral 20.

The wallet is made of four waterproof plastic sheets 22, of which the largest is the outer sheet 24 having a generally elongated rectangular shape. A fold 25 extends transversely across the outer sheet between the opposite parallel longitudinally extended edges 26 and parallel to the relatively short end edges 27. The wallet is firmly sealed 28 around its entire periphery.

Holes 29 extend through the wallet and interrupt the central reinforced fold 25. Preferably when the folds are formed, the plastic material is flowed upward to reinforce the holes.

Figure 8:
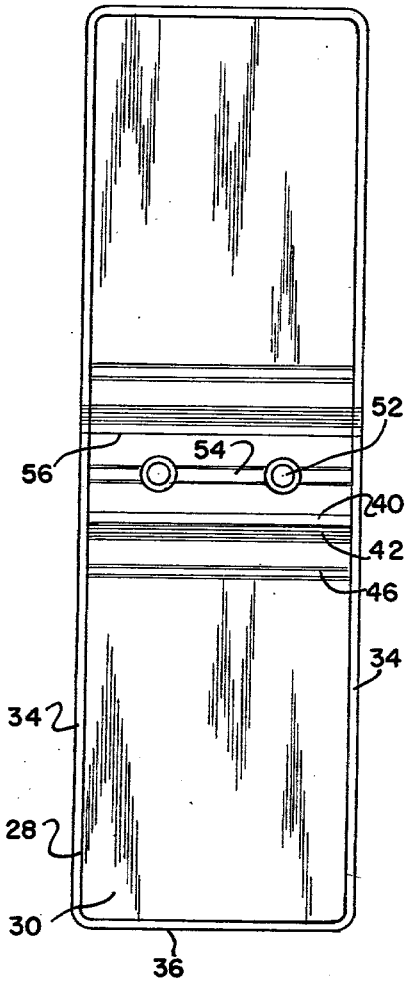
FIG. 8 shows the embodiment of FIGS. 6 and 7 from the pocket side.
Figure 9:
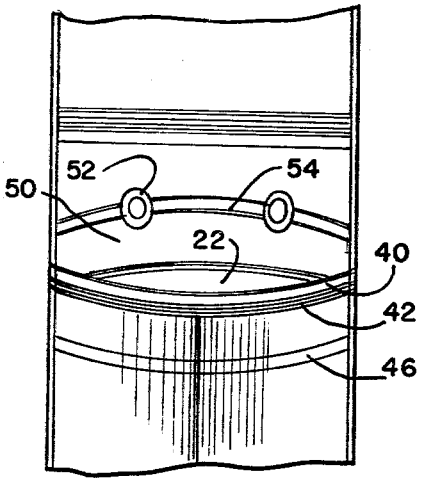
FIG. 9 is a detail of the openings and seal in the preferred form of the wallet.

As shown in FIG. 8, pocket pieces 30 have three edges, longitudinal edges 32 and 34 and outer end edge 36 sealed at 28 to the outer sheet. End 38 is left open to receive materials in the pockets. The free edges 40 of the pockets are reinforced and colored to provide pull tabs to separate seals 42 and open the pockets. A small strip 44 of the pocket sheet separates the seal 42 from a heat formed crease 46 to minimize flexure of the seal area due to materials held in the pocket. A middle inner piece 50 is secured to the outer sheet 24 along elongated edges 26 of the outer sheet. Openings 52 in the inner sheet correspond to the holes 29 and the edges of the openings are heat welded with edges of the holes. The fold area 54 is welded to the fold area 25 on the outer sheet and creases are formed in the inner middle sheet adjacent the fold area 54 to facilitate bending of the wallet. Parallel seal strips 56 are formed on the inner sheet to engage with complementary seal strips 42 on the pocket sheets 30.

While the invention has been described with reference to specific embodiments, it will be obvious to those skilled in the art that modifications and variations of the invention may be constructed without departing from the scope of the invention. The scope of the invention is defined in the following claims.

What is claimed is:

1. A watertight wallet of plastic material adapted to be attached to a swimmer's garment comprising an elongated foldable plastic member with a longitudinal axis and a medial fold line transverse to said longitudinal axis, an article receiving pocket permanently fused on three edges to the foldable member with a fourth edge comprising a watertight sealing means which cooperates with complementary sealing means on the foldable member, wherein the watertight sealing means and the complementary sealing means are located near and parallel to the fold line, attachment means on the fold line of the foldable member to facilitate securing the watertight wallet to the swimmer's garment, wherein a swimmer may couple the wallet to the garment by folding the wallet about a top edge of the garment.

2. The waterproof wallet of claim 1 further comprising stiffening means mounted on the foldable member on opposite sides of a fold and along the fold, for providing strength.

3. The waterproof wallet of claim 1 wherein the foldable member is made of an opaque plastic.

4. The waterproof wallet of claim 1 wherein the wallet has two transparent inner plastic pockets permanently sealed on three sides to the outer foldable member.

5. The waterproof wallet of claim 4 wherein the two transparent plastic pockets are formed on opposite sides of the fold, mouths of the transparent plastic pockets opening toward and parallel to the fold.

6. The waterproof wallet of claim 1 wherein the complementary sealing means mounted on the member comprises two strips in the plastic member housing plural grooves adjacent the foldline adapted to accomodate plural ribs correspondingly formed at the fourth edge of the pocket.

7. The waterproof wallet of claim 1 wherein the attaching means comprises two openings located on the fold of the plastic foldable member and spaced equidistant from the edges.

8. The waterproof wallet of claim 1 wherein the wallet comprises two elongated generally rectangular pockets, each pocket closed along longitudinally extended sides thereof and one longitudinal end and opened at a longitudinal end near the transverse fold and having means at the open end for securing the pocket in a complete watertight seal.

9. The waterproof wallet of claim 8 wherein the pocket has an integrally formed free edge of the pocket extending between longitudinally extended sides at the open end thereof.

10. The waterproof wallet of claim 8 further comprising a fold in the pocket extending transversely between longitudinally extending sides and slightly spaced from and parallel to the sealing means at the open end.

11. The waterproof wallet of claim 1 further comprising plural reinforced openings extending through the foldable member at the transverse fold.

12. The waterproof wallet of claim 11 wherein the wallet has two pockets and the foldable member and pockets are formed of an outer generally rectangular elongated sheet, first and second inner pocket sheets joined along three exterior edges of the pocket sheets to corresponding edges of the outer sheet and having ends slightly spaced from the central fold, an inner central sheet positioned medially on the outer sheet and extending transversely between opposite longitudinally extended edges and being peripherally sealed to the outer sheet, the relatively short transverse fold and the reinforced openings being formed in the outer sheet and inner central sheet, and parallel complementary sealing means on the inner central sheet for connecting to first sealing means on inner end portions of the pocket sheets.

13. The watertight wallet of claim 1 wherein the wallet comprises two pockets and the sealing means for each pocket is located parallel to the fold line along an outside edge or edges of the foldable member.

14. The watertight wallet of claim 1 wherein the outer surface of the foldable member consists of a simulated suede finish.

15. A watertight wallet comprising a rectangular folded member having a long medial transverse fold whose length is nearly equal to the length of the rectangular member, thereby forming an inside and an outside of the folded member, a pocket formed by a rectangular sheet overlying a portion of the inside of the folded member and fused to the folded member along three outer edges, leaving open a fourth edge nearest and parallel to the fold, watertight releasable sealing means having a first part connected to the sheet along its fourth edge and having a second part connected to the inside of the elongated member and underlying the first part for tightly engaging and holding the fourth edge in watertight relationship, wherein said wallet may be coupled to a swimmer's garment by folding the wallet about a top edge of the swimmer's garment.

16. The watertight wallet of claim 15 further comprising a second pocket formed by a second sheet overlying a spaced portion of the inside of the folded member and attached thereto along three outer edges and having a sealing means similar to the first pocket.

17. The waterproof wallet of claim 16 wherein the attaching means comprises two openings in the form of loops located within the pockets.

18. The waterproof wallet of claim 17 wherein the two openings in the form of loops are sealed.

19. The wallet of claim 17 wherein the two openings are in registration when the member is folded.

20. The watertight wallet of claim 16 where the sealing means are parallel to and spaced from the fold.

21. The watertight wallet of claim 20 further comprising free edges attached to sheets along the fourth edges and extending toward the fold.

22. The watertight wallet of claim 20 wherein the rectangular folded member is elongated, and the medial transverse fold is perpendicular to a long dimension of the folded member.

23. The watertight wallet of claim 22 wherein a sheet material underlies the fold on the inside of the folded member and joins the folded member along two opposite edge portions, with remaining edges providing cooperating sealing means with the fourth edges of the pockets adjacent the fold line.

24. The watertight wallet of claim 23 wherein the wallet has attaching means which comprise holes on the fold to facilitate securing the wallet to the swimmer's garment, the holes passing through the fold and the sheet material underlying the fold.

25. The watertight wallet of claim 24 further comprising a series of ridges near the fold on the outside of the folded member.

26. The watertight walls of claim 24 wherein a heat formed crease on the pocket sheet is located adjacent and parallel to the sealing means to minimize flexure of the sealing means due to materials held in the pocket.

27. A watertight wallet comprising an elongated rectangular folded member having a short medial transverse fold whose length is shorter than a length of the rectangular member, thereby forming an inside and an outside of the folded member, a pocket formed by a rectangular sheet overlying a portion of the inside of the folded member and fused to the folded member along three outer edges, leaving open a fourth edge nearest and parallel to the fold, watertight releasable sealing means having a first part connected to the sheet along its fourth edge and having a second part connected to the inside of the elongated member and underlying the first part for tightly engaging and holding the fourth edge in watertight relationship, wherein said wallet may be coupled to a swimmer's garment by folding the wallet about a top edge of the swimmer's garment.

28. The watertight wallet of claim 27 further comprising a second pocket formed by a second sheet overlying a spaced portion of the inside of the folded member and attached thereto along three outer edges and having a sealing means similar to the first pocket.

29. The watertight wallet of claim 28 where the sealing means are spaced from the fold.

30. The watertight wallet of claim 29 further comprising free edges attached to sheets along the fourth edges and extending toward the fold.

* * * * *